United States Patent [19]

Rose et al.

[11] Patent Number: 4,806,256

[45] Date of Patent: Feb. 21, 1989

[54] WATER-BASED HYDRAULIC FLUIDS

[75] Inventors: Gene D. Rose; Arthur S. Teot, both of Midland, Mich.

[73] Assignee: The Dow Chemical Company, Midland, Mich.

[21] Appl. No.: 3,003

[22] Filed: Jan. 13, 1987

Related U.S. Application Data

[63] Continuation-in-part of Ser. No. 622,030, Jun. 18, 1984, abandoned.

[51] Int. Cl.[4] ..... C09K 5/00

[52] U.S. Cl. ..... 252/71; 252/75; 252/76; 252/77; 252/79

[58] Field of Search ..... 252/49.3, 71, 75, 76, 252/77, 79

[56] References Cited

U.S. PATENT DOCUMENTS

| | | | |
|---|---|---|---|
| 3,172,910 | 3/1965 | Brace | 564/209 |
| 3,373,107 | 3/1968 | Rice et al. | 252/8.55 |
| 3,661,784 | 5/1972 | Bellos | 252/49.3 |
| 3,775,126 | 11/1973 | Babbit et al. | 106/125 |
| 4,534,875 | 8/1985 | Rose | 252/71 |

FOREIGN PATENT DOCUMENTS

| | | | |
|---|---|---|---|
| 3212969 | 10/1983 | Fed. Rep. of Germany | 252/49.3 |
| 3224148 | 12/1983 | Fed. Rep. of Germany | 252/49.3 |

OTHER PUBLICATIONS

Gravsholt, Journal of Coll. & Interface Sci., 57 (3), pp. 575–576 (1976), Article Entitled "Viscoelasticity in Highly Dilute Aqueous Solutions of Pure Cationic Detergents".

*Primary Examiner*—William R. Dixon, Jr.
*Assistant Examiner*—Margaret B. Medley

[57] ABSTRACT

Water-based hydraulic fluids are thickened by admixing the fluid with a viscoelastic surfactant. Viscoelastic surfactants comprise surfactant ions and organic counterions that associate with the hydraulic fluid to form the viscoelastic surfactant. Water-based hydraulic fluids of this invention are highly shear stable and do not experience substantial viscosity loss with an increase in temperature. The hydraulic fluids are capable of providing low amounts of wear in pumping apparatus during use.

25 Claims, No Drawings

WATER-BASED HYDRAULIC FLUIDS

CROSS-REFERENCE TO RELATED APPLICATION

This is a continuation-in-part of U.S. application Ser. No. 622,030, filed June 18, 1984, now abandon.

BACKGROUND OF THE INVENTION

The present invention relates to water-based hydraulic fluids, and in particular, to those water based hydraulic fluids which contain synthetic thickeners.

Petroleum oils have traditionally been used as hydraulic fluids. Such oils exhibit Newtonian viscosity behavior. A Newtonian fluid is a fluid that possesses a viscosity which is independent of the velocity gradient. Thus, the shear stress ($\tau$) is related to the shear rate ($\dot{\gamma}$) by the equation:

$$\tau=\eta\dot{\gamma}$$

wherein $\eta$ is the shear rate independent viscosity. Further, petroleum oils have a viscosity that is fairly constant throughout the lifetime of the fluid at prolonged high shear rates. This mechanical stability to shear degradation is a desired property of hydraulic fluids. The shear stable Newtonian viscosity of a typical hydraulic oil is generally in the range of 10 to 100 centistokes at 100° F.

Water-based lubricant products are gaining popularity due to shortages of petroleum base supplies, environmental concerns caused by problems in disposing of oil-based wastes, cost incentives and fire safety considerations. Typically, a water-based hydraulic fluid consists of several water-soluble or emulsifiable additives such as corrosion inhibitors (alkanolamines), lubricity aids (long chain carboxylic acid salts) and/or extreme pressure additives (zinc dialkyldithiophosphates, phosphate esters, borates, etc.). However, such an additive package has a viscosity that is essentially equal to that of water. It is desirable to thicken such a water-based lubricant with a thickening agent to overcome the problems associated with the use of a low viscosity fluid.

Increased viscosity of the water-based hydraulic fluids is desirable for several reasons. In particular, thickened fluid can aid in the operation of system valves which have been designed to work specifically with oil-based fluids. Further, thickened fluids are less prone to experience leaking through small holes or cracks in the hydraulic system. Higher pump efficiencies are obtainable with thickened fluids, especially at high loads, and such fluids exhibit wear prevention characteristics in both hydrodynamic and elastohydrodynamic wear modes. Thus, water-based hydraulic fluids are typically prepared using viscosifying amounts of polymeric thickeners.

Unfortunately, hydraulic fluids are subjected to high rates of shear, often in excess of $10^6$ $sec^{-1}$. Such high rates of shear can rapidly mechanically degrade efficient, high molecular weight polymeric thickeners. This irreversible shear thinning yields hydraulic fluid formulations containing polymeric materials having lower molecular weights which are less efficient thickeners. Thus, the viscosity of such a formulation containing a polymeric thickener will decrease after periods of use. Viscosity loss due to shear degradation can be minimized by employing low molecular weight polymeric thickeners. However, such low molecular weight polymeric thickeners are not efficient thickeners and require large amounts of polymer in order to obtain a formulation exhibiting the desired viscosity.

In view of the deficiencies of the prior art, it would be highly desirable to provide a water-based hydraulic fluid composition which is highly shear stable, does not experience substantial viscosity loss upon increases in temperature and is capable of providing acceptably low amounts of wear in pumping apparatus during use.

SUMMARY OF THE INVENTION

The present invention is a method of improving a water-based hydraulic fluid, comprising the step of contacting the fluid with surfactant ions and organic counterions to form an aqueous solution under suitable solution conditions whereby the surfactant ions and organic counterions associate in the hydraulic fluid thereby forming a viscoelastic surfactant.

Typically, the concentration of viscoelastic surfactant employed is an amount sufficient to provide a hydraulic fluid having a viscosity approaching that of an oil based hydraulic fluid.

In another aspect, the present invention is an improved water-based hydraulic fluid made according to the method described above comprising a lubricant, a corrosion inhibitor, surfactant ions and organic counterions and water; the components of the fluid being combined to form an aqueous solution under suitable solution conditions whereby the surfactant ions and organic counterions associate in the hydraulic fluid thereby forming a viscoelastic surfactant.

The improved hydraulic fluids of this invention are thickened with the viscoelastic surfactant, which is a highly efficient thickening agent that can provide shear stability. Such thickened formulations can exhibit viscosities which are substantially independent of temperature and can provide low amounts of wear in pumping apparatus during use.

The hydraulic fluids of this invention can be used in a wide variety of applications in which oil or water based hydraulic fluids have been used (i.e., under conditions where a fluid having a viscosity between about 10 and about 100 centistokes at 100° F. would be desirable). Of particular interest are pumping devices containing internal parts composed of low wear or wear resistant synthetic materials.

DETAILED DESCRIPTION OF THE INVENTION

*The Condensed Chemical Dictionary,* Tenth Ed., 1981, defines a hydraulic fluid as a liquid or mixture of liquids designed to transfer pressure from one point to another. As used herein, a water based hydraulic fluid comprises an aqueous liquid, a thickening agent, a lubricant and a corrosion inhibitor.

An aqueous liquid refers to liquids which contain water. Included herein are substantially pure water, water containing inorganic salts, and aqueous alkaline and acidic solutions. Aqueous liquids include mixtures of water and water-miscible liquids such as lower alkanols, e.g., methanol, ethanol or propanol; glycols and polyglycols and the like, provided that the concentration of water-miscible liquids does not adversely affect the viscoelastic properties of the aqueous liquid. Also included are emulsions of immiscible liquids in water and aqueous slurries of solid particulates. The preferred aqueous liquid is substantially pure water.

The thickening agent of this invention is a viscoelastic surfactant. The definition of viscoelastic surfactant and the classes of viscoelastic surfactants suitably employed in this invention are discussed below.

Lubricants include metal or amine salts of an organo sulfur, phosphorus, boron or carboxylic acid. Typical of such salts are carboxylic acids of 1 to 22 carbon atoms including both aromatic and aliphatic acids; sulfur acids such as alkyl and aromatic sulfonic acids and the like; phosphorus acids such as phosphoric acid, phosphorous acid, phosphinic acid, acid phosphate esters, and analogous sulfur homologs such as the thiophosphoric and dithiophosphoric acid and related acid esters; mercaptobenzothiozole; boron acids including boric acid, acid borates and the like. Lauric acid amine salts are preferred.

Corrosion inhibitors include alkali metal nitrites, nitrates, phosphates, silicates and benzoates may be added as liquid-vapor phase corrosion inhibitors. Representative suitable organic inhibitors include hydrocarbyl amine and hydroxy-substituted hydrocarbyl amine neutralized acid compound, such as neutralized phosphates and hydrocarbyl phosphate esters, neutralized fatty acids (e.g., those having 8 to about 22 carbon atoms), neutralized aromatic carboxylic acids (e.g., 4-(t-butyl)-benzoic acid), neutralized naphthenic acids and neutralized hydrocarbyl sulfonates. Mixed salt esters of alkylated succinimides are also useful. Preferred corrosion inhibitors are the alkanolamines such as ethanolamine, diethanolamine, triethanolamine and the corresponding propanolamines. Most preferred are morpholine, ethylenediamine, N,N-diethylethanolamine, alpha- and gamma-picoline, piperazine and isopropylaminoethanol.

A hydraulic fluid may also include additives for specific applications to optimize the performance of the fluid. Examples include colorants; dyes; deodorants such as citronella; bactericides and other antimicrobials; water softeners such as an ethylene diamino tetraacetate sodium salt or nitrilo triacetic acid; anti-freeze agents such as ethylene glycol and analogous polyoxyalkylene polyols; anti-foamants such as silicone-containing agents and shear stabilizing agents such as commercially available polyoxyalkylene polyols. Anti-wear agents, friction modifiers, anti-slip and lubricity agents may also be added. Also included are extreme pressure additives such as phosphate esters and zinc dialkyl dithiophosphate. See, for example, U.S. Pat. No. 4,257,902.

Many of the ingredients described above for use in making the substantially oil-free hydraulic fluids of this invention are industrial products which impart more than one property to the composition. Thus, a single ingredient can provide several functions thereby eliminating or reducing the need for some other additional ingredient. Thus, for example, a dispersing agent may also serve in part as an inhibitor of corrosion. Similarly, it may also serve as a neutralizing agent to adjust pH or as a buffer to maintain pH. Similarly, a lubricity agent such as tributyltin oxide can also function as a bactericide. In addition, a fatty acid composition, when employed in small amounts as a lubricity aid, may also act as a viscosity enhancing agent (see Example 3).

Traditionally, engineers and scientists have been concerned with two separate and distinct classes of materials - the viscous fluid and the elastic solid. The simple linear engineering models, Newton's law for flow and Hooke's law for elasticity, worked well because most traditional materials (e.g., water, motor oil, and steel) fell in one of these two categories. However, as polymer science developed, scientists realized that these two categories represented only the extremes of a broad spectrum of material properties, and that polymers fell somewhere in the middle. As a result, polymer melts and solutions were characterized as "viscoelastic". The term "viscoelastic" refers to polymers that exhibit a combination of viscous (liquid-like) and elastic (solid-like) properties.

The phenomeno of viscoelasticity has been discovered in certain aqueous surfactant solutions. Surfactants consist of molecules containing both polar and non-polar groups. They have a strong tendency to adsorb at surfaces or interfaces and thereby lower the surface or interfacial tension. Solutions of surfactants also form micelles, which are organized aggregates of the surfactants. A selected group of surfactant solutions also impart viscoelasticity to the solution as well. (See S. Gravsholt, *J. Coll. and Interface Sci.*, 57 (3) pp. 575–6 (1976), for a study of various surfactant compositions that impart viscoelasticity to aqueous solutions.) However, typical surfactant compositions will not inherently possess viscoelastic properties. As reported in H. Hoffmann, *Advances in Coll. and Interface Sci.*, 17 pp. 276 (1982), surfactant compositions that impart viscoelastic properties to solutions are rare. Therefore, although all surfactant compositions will reduce surface tension, few will impart viscoelasticity. Those that do are known as "viscoelastic surfactants", and they possess desirable properties. It has been discovered that viscoelastic surfactants can be added to a water-based heat transfer fluid to improve its performance (U.S. Pat. No. 4,534,875).

Viscoelasticity is caused by a different type of micelle formation than the usual spherical micelles formed by most surfactant compositions. Viscoelastic surfactants form rod-like or cylindrical micelles. Although cylindrical micelles and spherical micelles have about the same diameter of 50 Å, cylindrical micelles can reach 1,000 to 2,000 Å in length and contain hundreds of individual surfactant molecules. This high degree of association requires a specific set of conditions that can only be achieved by matching the surfactant composition with a suitable solution environment. The solution environment will depend on factors such as the type and concentration of electrolyte and the structure and concentration of organic compounds present. Therefore, a surfactant composition may form cylindrical micelles in one solution to impart viscoelastic properties to it and form spherical micelles in another solution. The solution with spherical micelles will exhibit normal surfactant behavior and will not exhibit viscoelasticity.

The formation of long, cylindrical micelles in viscoelastic surfactants creates useful rheological properties. First, viscoelastic surfactants exhibit reversible shear thinning behavior. This means that under conditions of high shear, such as when the composition is passed through a pump, the composition will exhibit low viscosity. When the conditions of high shear are replaced with conditions of low shear, such as obtained when the composition has left the pump, the original high viscosity is restored. Furthermore, viscoelastic surfactants will remain stable despite repeated passes through the pump. Since high molecular weight polymeric thickeners wil degrade when subjected to the high shear in a pump, viscoelastic surfactants have an advantage regarding shear stability over high molecular weight polymers. Although shear stability can be achieved with polymeric thickeners if the polymer molecular weight is low, the concentration of low molecular weight polymer to achieve a given viscosity is much greater than the concentration of thickening agent required if a viscoelastic surfactant is employed.

The major test specified by the references discussed above to determine if an aqueous solution possesses viscoelastic properties consists of swirling the solution and visually observing whether the air bubbles created by the swirling recoil after the swirling is stopped. This has been the traditional test for many years. It is possible to quantify the degree of viscoelasticity a solution possesses by measuring the time required for the recoil motion to stop, as described in an article by J. Nash, *J. of Appl. Chem.*, 6, pp. 540 (1956).

The surfactant compositions within the scope of this invention are ionic viscoelastic surfactants. The proper choice of counterion structure and solution environment give viscoelasticity. What follows is a discussion of ionic surfactant compounds and the counterions necessary to impart viscoelasticity to hydraulic fluids In general, ionic surfactant compounds comprise an ionic, hydrophilic moiety chemically bonded to a hydrophobic moiety (herein called a surfactant ion) and a counterion sufficient to satisfy the charge of the surfactant ion. Examples of such surfactant compounds are represented by the formula:

$$R_1(Y^{\oplus})X^{\ominus} \text{ or } R_1(Z^{\oplus})A^{\ominus}$$

wherein $R_1(Y^{\oplus})$ and $R_1(Z^{\ominus})$ represent surfactant ions having a hydrophobic moiety represented by $R_1$ and an ionic, solubilizing moiety represented by the cationic moiety $Y^{\oplus}$ or the anionic moiety $Z^{\ominus}$ chemically bonded thereto. $X^{\ominus}$ and $A^{\oplus}$ are the counterions associated with the surfactant ions.

In general, the hydrophobic moiety (i.e., $R_1$) of the surfactant ion is a hydrocarbyl or inertly substituted hydrocarbyl radical having one or more substituent groups, e.g., halo groups, which are inert to the aqueous liquid and components contained therein. Typically, the hydrocarbyl radical is an aralkyl group or a long chain alkyl or inertly substituted alkyl, which alkyl groups are generally linear and have at least about 12 carbon atoms. Representative long chain alkyl and alkenyl groups include dodecyl (lauryl), tetradecyl (myristyl), hexadecyl (cetyl), octadecenyl (oleyl), octadecyl (stearyl) and the derivatives of tallow, coco and soya. Preferred alkyl and alkenyl groups are generally alkyl and alkenyl groups having from about 14 to about 24 carbon atoms, with octadecenyl hexadecyl, erucyl and tetradecyl being the most preferred.

The cationic, hydrophilic moieties or groups, i.e., $Y^{\oplus}$, are generally onium ions wherein the term "onium ions" refers to a cationic group which is essentially completely ionized in water over a wide range of pH, e.g., pH values from about 2 to about 12. Representative onium ions include quaternary ammonium groups, i.e., $-N^{\oplus}(R)_3$; tertiary sulfonium groups, i.e., $-S^{\oplus}(R)_2$; quaternary phosphonium groups, i.e., $-P^{\oplus}(R)_3$ and the like, wherein each R is individually a hydrocarbyl or inerly substituted hydrocarbyl. In addition, primary, secondary and tertiary amines, i.e., $-NH_2$, $-NHR$ or $-N(R)_2$, can also be employed as the ionic moiety if the pH of the aqueous liquid being used is such that the amine moieties will exist in ionic form. A pyridinium moiety can also be employed. Of such cationic groups, the surfactant ion of the viscoelastic surfactant is preferably prepared having quaternary ammonium, i.e., $-N^{\oplus}(R)_3$; a pyridinium moiety; an aryl- or alkaryl-pyridinium; or imidazolinium moiety; or tertiary amine, $-N(R)_2$, groups wherein each R is independently an alkyl group or hydroxyalkyl group having from 1 to about 4 carbon atoms, with each R preferably being methyl, ethyl or hydroxyethyl.

Representative anionic, solubilizing moieties or groups, herein designated $Z^{\ominus}$, include sulfate groups, ether sulfate groups, sulfonate groups, carboxylate groups, phosphate groups, phosphonate groups, and phosphonite groups. Of such anionic groups, the surfactant ion of the viscoelastic surfactants is preferably prepared having a carboxylate or sulfate group. For purposes of this invention, such anionic solubilizing moieties are less preferred than cationic moieties.

Fluoroaliphatic species suitably employed in the practice of this invention include organic compounds represented by the formula:

$$R_fZ^1$$

wherein $R_f$ is a saturated or unsaturated fluoroaliphatic moiety, preferably containing a $F_3C-$ moiety and $Z^1$ is an ionic moiety or potentially ionic moiety. The fluoroaliphatics can be perfluorocarbons. Suitable anionic and cationic moieties will be described hereinafter. The fluoroaliphatic moiety advantageously contains from about 3 to about 20 carbons wherein all can be fully fluorinated, preferably from about 3 to about 10 of such carbons. This fluoroaliphatic moiety can be linear, branched or cyclic, preferably linear, and can contain an occasional carbon-bonded hydrogen or halogen other than fluorine, and can contain an oxygen atom or a trivalent nitrogen atom bonded only to carbon atoms in the skeletal chain. More preferable are those linear perfluoroaliphatic moieties represented by the formula: $C_nF_{2n+1}$ wherein n is in the range of about 3 to about 10. Most preferred are those linear perfluoroaliphatic moieties represented in the paragraphs below.

The fluoroaliphatic species can be a cationic perfluorocarbon and is preferably selected from a member of the group consisting of $CF_3(CF_2)_rSO_2NH(CH_2)_sN^{\oplus}R''_3X^{\ominus}$; $R_fCH_2CH_2SCH_2CH_2N^{\oplus}R''_3X^{\ominus}$ and $CF_3(CF_2)_rCONH(CH_2)_sH^{\oplus}R''_3X^{\ominus}$; wherein $X^{\ominus}$ is a counterion described hereinafter, R'' is lower alkyl containing between 1 and about 4 carbon atoms, r is about 2 to about 15, preferably about 2 to about 6, and s is about 2 to about 5. Examples of other preferred cationic perfluorocarbons, as well as methods of preparation, are those listed in U.S. Pat. No. 3,775,126.

The fluoroaliphatic species can be an anionic perfluorocarbon and is preferably selected from a member of the group consisting of $CF_3(CF_2)_pSO_2O^{\ominus}A^{\oplus}$, $CF_3(CF_2)_pCOO^{\ominus}A^{\oplus}$, $CF_3(CF_2)_pSO_2NH(CH_2)_qSO_2O^{\ominus}A^{\oplus}$ and $CF_3(CF_2)_pSO_2NH(CH_2)_qCOO^{\ominus}A^{\oplus}$; wherein p is from about 2 to about 15, preferably about 2 to about 6, q is from about 2 to about 4, and $A^{\oplus}$ is a counterion described hereinafter. Examples of other preferred anionic perfluorocarbons, as well as methods of preparation, are illustrated in U.S. Pat. No. 3,172,910.

The counterions (i.e., $X^{\ominus}$ or $A^{\oplus}$) are organic ions that have a charge opposite that of the surfactant ions. The counterions and surfactant ions associate in the hydraulic fluid and impart viscoelastic properties to it. Organic ions that are anionic serve as counterions for surfactant ions having a cationic, hydrophilic moiety; and the organic ions that are cationic serve as counterions for surfactant ions having an anionic, hydrophilic moiety. The organic counterions are formed by dissociation of the corresponding salts, acids, or bases.

The preferred anionic counterions are sulfonates or carboxylates. Representative of such anionic counterions which, when employed with a cationic surfactant ion, are capable of imparting viscoelastic properties to the hydraulic fluid include various aromatic sulfonates such as p-toluene sulfonate and naphthalene sulfonate; chlorobenzoic acid; and the like, where such counterions are water-soluble. Most preferred are salicylate; p-toluene sulfonate; 3,4-dichlorobenzoate; and an alkyl diphenyl ether disulphonate sold by The Dow Chemical Company, under the trademark "DOWFAX 2A1", especially where the alkyl group is octadecyl.

The cationic counterions may be an onium ion. The most preferred onium ion is cyclohexylamine. Other preferred onium ions include those with a quaternary ammonium group. Representative cationic counterions in the form of a quaternary ammonium group include benzyl trimethyl ammonium or alkyl trimethyl ammonium wherein the alkyl group is advantageously octyl, decyl, dodecyl, and the like. It is highly desirable to avoid stoichiometric amounts of surfactant and counterion when the alkyl group of the counterion is large. The use of a cation as the counterion is generally less preferred than the use of an anion as the counterion.

The particular surfactant ion and the counterion associated therewith are selected such that the combination imparts viscoelastic properties to an aqueous liquid. Of the aforementioned surfactant ions and counterions, those combinations which form such viscoelastic surfactants will vary but are easily determined by the test methods hereinbefore described. The surfactants which impart viscoelastic properties to an aqueous liquid include those represented by the formula:

$$CH_3\text{-}(CH_2)_n\text{-}\overset{\overset{R}{|}}{\underset{\underset{R}{|}}{N}}{}^{\oplus}R\ X^{\ominus}$$

wherein n is an integer from about 13 to about 23, preferably an integer from about 15 to about 21; each R is independently an alkyl group, or alkylaryl, preferably independently methyl, ethyl or benzyl; and $X^{\oplus}$ is a salicylate or 3,4-dichlorobenzoate. In addition, the R can combine to form a pyridinium moiety. Especially preferred surfactant ions include cetyltrimethylammonium, myristyltrimethylammonium, and octadecenyltrimethylammonium. Combinations of surfactant compounds can also be employed.

The viscoelastic surfactants are easily prepared by admixing the basic form of the desired cationic surfactants ions with a stoichiometric amount of the acidic form of the desired anionic counterions or by admixing the acidic form of the desired anionic surfactant ions with a stoichiometric amount of the basic form of the desired cationic counterions. Alternatively, stoichiometric amounts of the salts of the surfactant ions and counterions can be admixed to form the viscoelastic surfactant. See, for example, the procedures described in U.S. Pat. No. 2,541,816.

Once the viscoelastic surfactant is prepared, the improved hydraulic fluid is prepared by admixing the viscoelastic surfactant with the aqueous liquid, lubricant, corrosion inhibitor, and other desired additives. The resulting fluid is stable and can be stored for long periods of time.

The concentration of viscoelastic surfactant required to impart viscoelastic properties to the fluid, where the viscoelasticity of the fluid is measured by the techniques previously described, is that which measurably increases the viscosity of the fluid and/or reduces wear on moving surfaces when the fluid is employed as a hydraulic fluid. The type and concentration of viscoelattic surfactant required depends on the particular application desired (such as leakage reduction, pump efficiency, lubricity, and the like); and on other factors such as solution composition, temperature, pressure and shear rate to which the flowing fluid will be subjected. In general, the requisite concentration of any specific viscoelastic surfactant is determined experimentally. For example, leakage prevention can be provided by employing a viscoelastic surfactant composition which exhibits a high viscosity at low shear rates. In addition, for example, increased lubricity can be provided to a fluid by employing a viscoelastic surfactant composition which exhibits low amounts of friction and wear. For further improvements in wear reduction, other additives which are compatible with the surfactant can be employed. Preferably, the concentration of viscoelastic surfactant ranges from about 0.1 to about 10 weight percent of the hydraulic fluid. More preferably, the concentration of viscoelastic surfactant ranges from about 0.5 to about 3 percent of the hydraulic fluid.

In a preferred embodiment of this invention, excess organic counterions are added to the hydraulic fluid to further increase its viscosity, increase its viscosity stability at higher temperatures, or both. The counterions employed will have a charge opposite that of the surfactant ions and will dissolve in the hydraulic fluid. Preferably, the excess organic counterions employed are the same as the counterions employed to associate with the surfactant ions to form the viscoelastic surfactant. However, the excess organic counterions can be different from the counterions which form the viscoelastic surfactant.

The concentration of excess organic counterions required to further increase the viscosity, increase the stability at higher temperatures, or both, will depend on the composition of the aqueous liquid, the surfactant ions and counterions employed, and the desired viscosity. Ordinarily, the concentration of excess counterions which will produce a noticeable effect ranges from about 0.1 to about 20, and more assuredly and preferably from about 0.5 to about 5, moles per mole of surfactant ions.

The hydraulic fluid may contain an emulsion of an immiscible liquid, such as an oil or other organic ingredient, at a concentration ranging from about 0.05 to about 20 weight percent of the hydraulic fluid. However, the concentration of immiscible liquid must be lower than that which will adversely affect the stability of the hydraulic fluid. Viscoelastic surfactants employed in such emulsions tend to lose their viscoelasticity, possibly because the oil penetrates the micelles and destroys the aggregates required for viscoelasticity. Viscoelastic surfactants containing excess organic counterions are capable of withstanding the addition of oil or other organic ingredient longer than those without the excess organic counterions. Moreover, fluorinated viscoelastic surfactants maintain viscosity stability in an emulsion longer at concentrations ranging up to about 50 weight percent, most preferably up to about 10 weight percent of the hydraulic fluid.

The fluids employed in the process of this invention can be employed under conditions in which previously known hydraulic fluids have been employed. Preferred applications include those processes where hydraulic apparatus is operated between about −25° F. and about 245° F. The fluids employed in the process of this invention also can exhibit improved performance over a flow rate/temperature range which is greater than fluids not containing the viscoelastic additives.

For example, certain viscoelastic surfactant compositions can have essentially identical viscosities at low and high temperatures. The properties of the viscoelastic surfactant can depend on the alkyl chain length of the surfactant ion in the fluid. Longer alkyl chain length surfactant ions and/or an excess of counterion increase the temperature to which the formulation can be employed. Thus, it is possible to design hydraulic fluids which match the particular flow rate, temperature, and pressure of a wide variety of hydraulic fluid applications.

The following examples are presented to illustrate the invention and should not be construed to limit its scope. All percentages and parts are by weight unless otherwise noted.

EXAMPLE I

A thickening agent for an aqueous hydraulic fluid is prepared by contacting an aqueous liquid with a viscoelastic surfactant composition. The formulation contains 99.25 percent water, 0.4 percent cetyltrimethylammonium salicylate, and 0.35 percent sodium salicylate. The formulation is subjected to a high shear of $10^6$ $sec^{-1}$ by passing it through a capillary at high pressure. Data concerning the viscosity of the formulation determined at various shear rates before and after the high shear capillary treatment using the Haake Rotovisco Model RV-3 rotational viscometer with an NV cup and bob measuring system are presented in Table I.

TABLE I

| Shear Rate ($sec^{-1}$) | Viscosity (cps) Before High Shear | After High Shear |
|---|---|---|
| 21.6 | 58.8 | 58.8 |
| 173 | 15.6 | 15.4 |
| 690 | 5.5 | 5.4 |
| 2760 | 2.7 | 2.7 |

The data in Table I indicate that the viscoelastic thickening agent exhibits viscosity stability before and after the formulation is subjected to high shear. The formulation exhibits a desirable viscosity that is highly shear stable.

EXAMPLE 2

A thickening agent for an aqueous hydraulic fluid is prepared by contacting an aqueous liquid with a viscoelastic surfactant composition. The formulation contains 97.5 percent deionized water and 2.5 percent erucyltrimethylammonium salicylate. The viscosity of the formulation is determined using a Haake Rotovisco, as described previously, at 25° C. at various shear rates. The viscosity of the formulation is also determined in a similar manner at 85° C. Data concerning the viscosity of the formulation at various shear rates and temperatures are presented in Table II.

TABLE II

| Shear Rate ($sec^{-1}$) | Viscosity (cps) at 25° C. | 85° C. |
|---|---|---|
| 0.5 | 2943.9 | 5766.3 |
| 2.2 | 736 | 1540.2 |
| 5.4 | 297.4 | 698 |
| 10.8 | 150.2 | 383.9 |
| 21.6 | 78.9 | 205.6 |
| 43.1 | 42.9 | 119.9 |
| 86.2 | 24.1 | 72.3 |
| 172.5 | 13.4 | 44.3 |
| 345 | 8.3 | 24.6 |
| 689.9 | 5.8 | 13.8 |

The data in Table II indicate that the viscoelastic thickening agent exhibits a high viscosity at low shear. This is desirable in that leakage of the formulation during use in a hydraulic fluid application is inhibited. The data also indicate that the formulation exhibits an increase in viscosity with increasing temperature.

EXAMPLE 3

A hydraulic fluid composition is prepared by contacting various components with deionized water. The composition contains 1.01 percent tetradecanoic acid, 0.32 percent of a mixed fatty acid composition similar to that composition sold commercially as NEO-FAT® 255 by Akzo Chemie America, 0.57 percent cyclohexylamine, 0.1 percent sodium dodecyl sulfate, 0.2 percent potassium phosphate, and 97.8 percent deionized water. This composition exhibits a pH of 10. This composition is designated as Sample No. 1.

In a like manner is prepared a composition containing 0.4 percent cetyltrimethylammonium salicylate, 0.07 percent dodecyltrimethylammonium salicylate, 0.15 percent sodium salicylate, 0.6 percent morpholine, 0.4 percent sodium borate decahydrate, 2 percent sodium sulfite, and 96.38 percent deionized water. The composition exhibits a pH of 9.6. This composition is designated as Sample No. 2.

Each of Sample Nos. 1 and 2 are evaluated on a Falex simulated vane pump test using a Falex Model 6 Friction and Wear Tester, and are compared to commercially available hydraulic fluids. Wear data are presented in Table III.

TABLE III

| Sample No. | Load (lb) | Inlet Temp. (°C.) | Torque (in-lb) | Wear (mg) |
|---|---|---|---|---|
| 1 | 200 | 25 | 18.6 | 6.3 |
| 2 | 200 | 23 | 4.1 | 8.9 |
| C-1* | 200 | 64.1 | 18.1 | 17.0 |
| C-2* | 200 | 71.4 | 21.2 | 14.1 |
| C-3* | 200 | 55.7 | 21.2 | 19.0 |

*Not an example of the invention.

The data in Table III indicate that hydraulic fluid formulations of this invention (i.e., Sample Nos. 1 and 2) exhibit a desirably low amount of wear during simulated use conditions, as compared to commercially available water based hydraulic fluids (i.e., Sample Nos. C-1, C-2 and C-3).

EXAMPLE 4

The formulations designated as Sample Nos. 1 and 2 in Example 3 are each evaluated using a Haake Rotovisco Model RV-3, as described previously, at 25° C. and 40° C. Data are presented in Table IV.

TABLE IV

| | Viscosity (cps) | | | |
|---|---|---|---|---|
| | Sample No. 1 at | | Sample No. 2 at | |
| Shear Rate $Sec^{-1}$ | 25° C. | 40° C. | 25° C. | 40° C. |
| 43.1 | — | 86.2 | 47.9 | 25.3 |
| 86.2 | 60.5 | 61.5 | 31.8 | 19.2 |
| 172.5 | 30.7 | 40.6 | 20.5 | 14 |
| 345 | 17.1 | 24.6 | 12.5 | 11.1 |
| 689.9 | 10.4 | 14.3 | 7.6 | 7.8 |
| 1379.8 | 7.2 | 8.7 | 4.9 | 5.3 |
| 2759.7 | 5.4 | 5.8 | 3.6 | 3.6 |

The data in Table IV indicate that hydraulic fluid formulations of this invention exhibit acceptable viscosities under conditions where said formulations are employed.

What is claimed is:

1. A method of improving a water-based hydraulic fluid containing a lubricant and a corrosion inhibitor, comprising the step of contacting the fluid with:

(a) surfactant ions having an ionic, hydrophilic moiety chemically bonded to a hydrophobic moiety, and (b) a stoichiometric amount of organic counterions, so as to form an aqueous solution under suitable solution conditions whereby the surfactant ions and organic counterions associate in the hydraulic fluid thereby forming a viscoelastic surfactant; wherein the concentration of viscoelastic surfactant ranges from about 0.1 to about 10 weight percent of the hydraulic fluid.

2. The method of claim 1 wherein the surfactant ions are cationic and the organic counterions are anionic.

3. The method of claim 2 wherein the organic counterions are aromatic ions.

4. The method of claim 3 wherein the cationic surfactant comprises a hydrophilic moiety selected from the group consisting of quaternary ammonium groups and quaternary phosphonium groups.

5. The method of claim 4 wherein the hydrophilic moiety is a quaternary ammonium group.

6. The method of claim 5 wherein the aromatic ions are selected from the group consisting of sulfonate ions and carboxylate ions.

7. The method of claim 6 wherein the aromatic ions are sulfonate ions.

8. The method of claim 6 wherein the aromatic carboxylate ions are salicylate ions.

9. The method of claim 1 wherein the surfactant ions comprise a hydrophobic moiety containing a fluoroaliphatic group.

10. The method of claim 9 wherein the fluoroaliphatic group is linear.

11. The method of claim 10 wherein the fluoroaliphatic group is a perfluorocarbon.

12. The method of claim 1 further comprising the addition of excess organic counterions.

13. The method of claim 1 wherein the viscoelastic surfactant ranges from about 0.5 to about 3 weight percent of the hydraulic fluid.

14. An improved water-based hydraulic fluid made according to the method of claim 1 comprising a lubricant; a corrosion inhibitor; surfactant ions having an ionic, hyrophilic moiety chemically bonded to a hydrophobic moiety and a stoichiometric amount of organic counterions; and water; the components of the fluid being combined so as to form an aqueous solution under suitable solution conditions whereby the surfactant ions and organic counterions associate in the hydraulic fluid thereby forming a viscoelastic surfactant; wherein the concentration of viscoelastic surfactant ranges from about 0.1 to about 10 weight percent of the hydraulic fluid.

15. The composition of claim 14 wherein the surfactant ions are cationic and the organic counterions are anionic.

16. The composition of claim 15 wherein the organic counterions are aromatic ions.

17. The composition of claim 16 wherein the cationic surfactant comprises a hydrophilic moiety selected from the group consisting of quaternary ammonium groups and quaternary phosphonium groups.

18. The composition of claim 17 wherein the hydrophilic moiety is a quaternary ammonium group.

19. The composition of claim 18 wherein the aromatic ions are selected from the group consisting of sulfonate ions and carboxylate ions.

20. The composition of claim 19 wherein the aromatic ions are salicylate ions.

21. The composition of claim 14 wherein the surfactant ions comprise a hydrophobic moiety containing a fluoroaliphatic group.

22. The composition of claim 21 wherein the fluoroaliphatic group is linear.

23. The composition of claim 22 wherein the fluoroaliphatic group is a perfluorocarbon.

24. The composition of claim 14 further comprising excess organic counterions.

25. The composition of claim 14 wherein the viscoelastic surfactant ranges from about 0.5 to about 3 weight percent of the hydraulic fluid.

* * * * *